US008567141B2

(12) United States Patent
Logan

(10) Patent No.: US 8,567,141 B2
(45) Date of Patent: Oct. 29, 2013

(54) PANEL ASSEMBLY FOR MOUNTING TO THE FAçADE OF A BUILDING

(76) Inventor: William F. Logan, Hastings-on-Hudson, NY (US)

( * ) Notice: Subject to any disclaimer, the term of this patent is extended or adjusted under 35 U.S.C. 154(b) by 366 days.

(21) Appl. No.: 12/932,105

(22) Filed: Feb. 17, 2011

(65) Prior Publication Data

US 2012/0210658 A1 Aug. 23, 2012

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 14/00*** | (2006.01) |
| ***E04B 2/96*** | (2006.01) |
| *E04H 1/02* | (2006.01) |

(52) U.S. Cl.
CPC .... *E04B 2/96* (2013.01); *E04H 1/02* (2013.01)
USPC ..... 52/235; 52/236.2

(58) Field of Classification Search
USPC ..... 52/235, 234, 236.3, 236.2, 245, 52/704–711, 220.8, 173.3, 306, 24; 138/106, 107, 112; 285/136.1, 285/139.1–139.3, 137.11; 248/123.11, 248/123.2, 218.4, 219.1, 219.2, 219.4; 403/192, 194, 197, 199, 201
See application file for complete search history.

(56) References Cited

U.S. PATENT DOCUMENTS

| | | | | |
|---|---|---|---|---|
| 5,221,363 | A | 6/1993 | Gillard | |
| 5,829,216 | A | 11/1998 | Newcomb et al. | |
| 6,105,319 | A * | 8/2000 | Brunt | 52/204.593 |
| 6,131,346 | A * | 10/2000 | Kordes | 52/235 |
| 6,158,177 | A * | 12/2000 | Blobaum | 52/208 |
| 6,250,798 | B1 | 6/2001 | Brainard et al. | |
| 6,430,894 | B1 * | 8/2002 | Chae et al. | 52/786.1 |
| 6,646,196 | B2 | 11/2003 | Fronek et al. | |
| 6,761,003 | B2 * | 7/2004 | Lind | 52/235 |
| 8,375,680 | B2 * | 2/2013 | Clair et al. | 52/786.13 |
| 2002/0020119 | A1 * | 2/2002 | Oberhofer et al. | 52/27 |
| 2002/0031398 | A1 | 3/2002 | Ginzel | |
| 2002/0178667 | A1 * | 12/2002 | Elmer | 52/235 |
| 2006/0162273 | A1 | 7/2006 | Viezens et al. | |
| 2006/0213139 | A1 | 9/2006 | Stramandinoli | |
| 2008/0194154 | A1 | 8/2008 | Minnick | |
| 2010/0050547 | A1 * | 3/2010 | Speck | 52/235 |
| 2010/0086007 | A1 | 4/2010 | Liao | |
| 2011/0227298 | A1 * | 9/2011 | Teng | 277/645 |

* cited by examiner

*Primary Examiner* — William Gilbert
*Assistant Examiner* — Kyle Walraed-Sullivan
(74) *Attorney, Agent, or Firm* — Watov & Kipnes, P.C.

(57) ABSTRACT

A panel assembly for mounting to the façade of a building which includes a panel member having a longitudinal axis, at least one opening through the panel member for receiving a fitting which is operatively engaged to a connection assembly, and an anchoring assembly receiving the connection assembly and securing the same to the façade.

19 Claims, 4 Drawing Sheets

60
A-1
40
A
12
14
10
16
60
60
B
72
72
60

FIG.3B
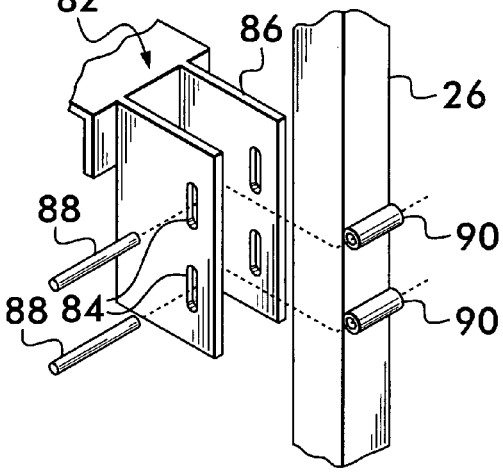
FIG.4
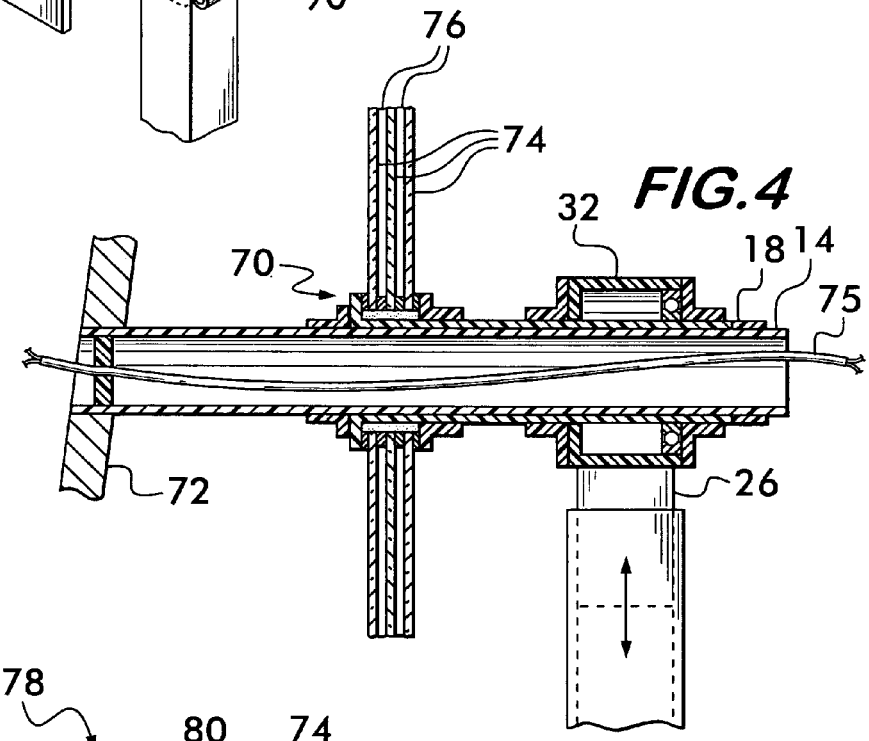
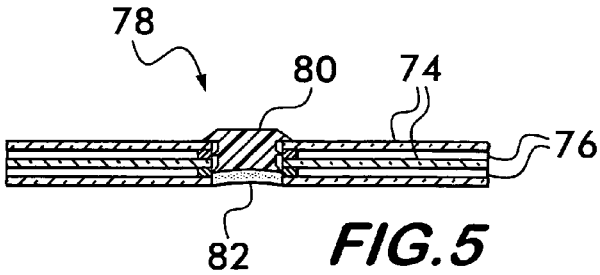
FIG.5

PANEL ASSEMBLY FOR MOUNTING TO THE FAçADE OF A BUILDING

FIELD OF THE INVENTION

The present invention is generally directed to a panel assembly for mounting to a façade of a building and more particularly to a panel assembly which permits mounting of panels having no perimeter frame to facilitate energy transmission efficiency, and the reduction of environmentally undesirable building materials. The panels have openings therein which permit the insertion of fittings for supporting the panels against weather related stresses. The fittings may be hollow and are positioned on the panels in a manner which provides desired support and resistance against wind and seismic related stresses.

BACKGROUND OF THE INVENTION

Modular construction of the façade of a building has typically employed panels which are mounted through perimeter frames to adjacent floors of a building. The panels typically are supported by the frame which extends along the entire perimeter of the panel. The frames are often constructed of solid supporting materials such as concrete, metal, rigid plastics and the like and therefore tend to be environmentally undesirable.

The perimeter frames have a track into which is mounted the edge portion of the panel which overlaps the panel along the edge portion. As a consequence, the edge portion represents a region of the modular construction where the solid supporting material and the panel material appear in the same general area of the façade.

The use of perimeter frames for the panels provides good support for panels as well as good alignment between adjacent panels sufficient to withstand weather-related stress (e.g. wind, rain, etc) but suffers from a number of disadvantages. A first disadvantage is the use of environmentally undesirable materials for the construction of the frame. A second disadvantage is that the perimeter frames typically require extensive use of protective coatings to minimize wear due to the extended exposure to the weather. The protective coatings are often made from environmentally undesirable materials.

A third disadvantage is the reduction in available surface area of the panels due to the covering of the edge portion thereof by the perimeter frame. As a result, the area of view throughout the panel from the inside of the building is reduced. In addition, the available surface area for light transmission through the panel to provide radiant heat and light into the building is likewise reduced.

A fourth disadvantage stems from the recent use of panels to facilitate the use of auxiliary systems (e.g. solar energy systems) to enable the façade of the building to be useful in providing a new or added function to the building. For example, solar panels have been associated with the panel construction to enable use of solar energy for supplemental heating, lighting, etc. To date, the incorporation of solar technology to panel constructions has been time-consuming and expensive, due in part to the use of perimeter frames.

There have also been employed frameless panels which typically are connected to the façade of a building at the respective corners of the panels. Such panels provide better visibility and light transmission because of the absence of perimeter frames.

The present invention is an improvement on the use of frameless panels wherein the panels are supported by fittings positioned away from the corners of the panels in which the fittings are positioned within openings in the panels. The fittings may be hollow which provides a pathway from the façade to the exterior of the panels that can be used for a variety of constructive purposes to facilitate energy transmission, ventilation, and the use of additions to the panels, including solar energy devices.

SUMMARY OF THE INVENTION

The present invention is directed to a panel assembly for mounting to the façade of a building in which the use of perimeter frames is eliminated. In one aspect of the invention there is provided a panel assembly for mounting to the façade of a building comprising:

a) a frameless panel member having a longitudinal axis;
b) at least one opening through the panel member positioned in an area proximate to the longitudinal axis;
c) a fitting having a first end portion extending into the opening and opposed second end portion;
d) a connection assembly operatively engaged to the fitting at said opposed second end portion; and
e) an anchoring assembly for receiving the connection assembly and securing the same to the façade of the building.

BRIEF DESCRIPTION OF THE DRAWINGS

The following drawings in which like reference characters indicate like parts are illustrative of embodiments of the invention and are not intended to limit the invention as encompassed by the claims forming part of the application.

FIG. 3B is an exploded view of a portion of one embodiment of the anchoring assembly;

FIG. 4 is a cross-sectional view of a panel assembly including a hollow fitting, connection assembly and anchoring assembly used to secure a panel assembly to the façade of a building with associated electronic wiring passing through the hollow fitting to an optional solar panel; and FIG. 5 is a cross-sectional view of a panel assembly showing a sealing assembly for providing a seal between adjacent panel members.

DETAILED DESCRIPTION OF THE INVENTION

The present invention is directed to a panel assembly for the façade of a building in which the panel members are secured to the façade in the absence of a perimeter frame.

As used herein, the term "perimeter frame" refers to a structure having a periphery in the shape of a desired panel member (e.g. rectangle, polygon, etc). The perimeter frame provides support for the panel member along the periphery thereof. The frame is attached to the façade of a building.

The term "frameless panel" refers to a panel member which is attached to the façade of a building which does not rely on a frame (as defined above) for such attachment. A frameless panel as used herein may be placed in sealed relationship to adjacent panel members through the use of a sealing component which is not a perimeter frame.

The term "façade" of a building shall refer to any portion of a building to which a panel assembly may be attached. Typically, the relevant portion of a building for attaching of a single panel assembly will be the floor of one level of the building and the floor of the next adjacent level of the building.

The term "in an area proximate to the longitudinal axis" refers to an area of the panel member (for placement of the opening and the fitting which enters the opening) which extends to either side of the longitudinal axis a distance of up to 10% of the width of the panel member, preferably no more than 5% of the width and most preferably about the longitudinal axis (i.e. a distance of no more than 1% of the width of the panel member)

The term "building" shall refer to any structure whether residential or commercial to which at least one panel assembly may be attached. A building will be comprised of at least one floor, typically multiple floors.

Figure 1:
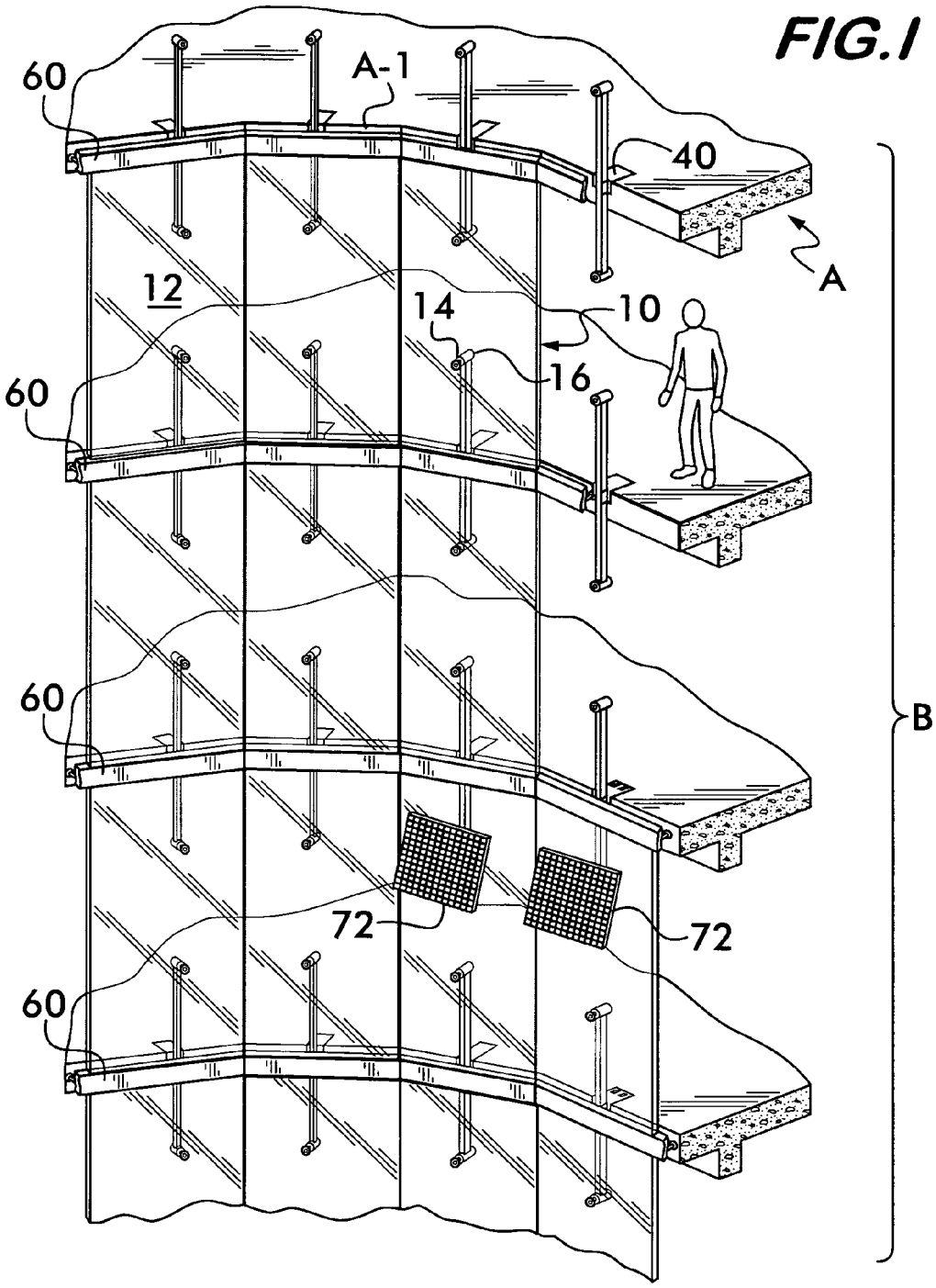
FIG. 1 is a perspective view of a portion of a façade of a building employing several panel assemblies in accordance with one embodiment of the invention.
Figure 2:
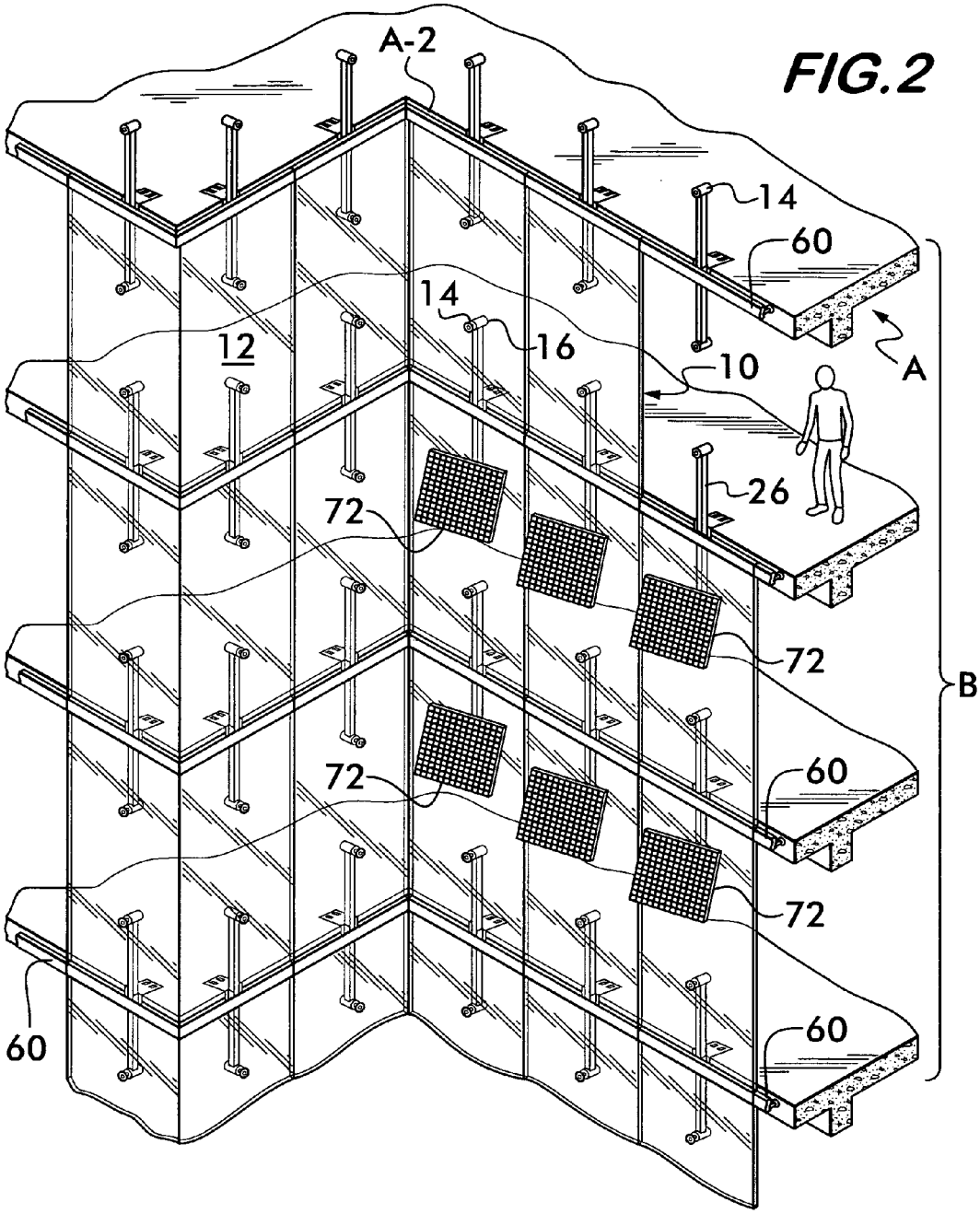
FIG. 2 is a perspective view of a portion of a façade of a building employing several panel assemblies in accordance with another embodiment of the invention.

Referring to the drawings and first to FIGS. 1 and 2, there is shown a plurality of panel assemblies 10 attached to the façade A of a multistory building B. The panel assembly 10 as shown best in FIGS. 3A-5 and as discussed in detail hereinafter is comprised of at least one panel member 12, typically a plurality of spaced apart panel members. The panel members 12 may be made of any suitable panel member construction material such as glass, plastic, composite materials and the like. Materials which are transparent or translucent are preferred. Glass is a preferred panel member material because it is a) relatively inexpensive, b) transparent and c) energy efficient.

The panel members may be connected to a façade A shown in FIG. 1 which has, at least in part, a curvilinear design shown by reference A-1. The panel members may also be connected to a façade A shown in FIG. 2 which has, at least in part, a rectilinear design shown by reference A-2, as described hereinafter.

The panel assembly 10 further includes a fitting 14 which directly connects the panel member 12 to the other components of the panel assembly 10 as hereinafter described to secure the panel member 12 to the façade A. The fitting 14 is operatively connected to the panel member 12 through a panel opening 16 which typically matches the shape of the fitting 14. As shown, for example, in FIG. 1 (see also FIG. 3A), the fitting 14 is cylindrical and preferably hollow (e.g. a hollow rod) and the panel opening 16 is thereby cylindrical and of sufficient diameter to enable receipt of the fitting 14. The fitting 14 is secured to the panel member by a pair of movable rings 18 which are pressed against the interior surface 20 and exterior surface 22 of the panel member 12 as shown best in FIG. 3.

The fitting 14 on the interior side of the panel member 12 is operatively connected to a connection assembly 24 comprised of a stanchion 26 having an upper end 28 and a lower end 30. The upper end 28 of the stanchion 26 is operatively engaged to an upper fitting 14 through a stanchion connector 32*b* while the lower end 30 of stanchion 26 is operatively engaged to a lower fitting through a stanchion connector 32*a*. Thus, a single stanchion 26 is operatively engaged to an upper and lower panel member 12 as shown best in FIG. 3A.

Figure 3A:
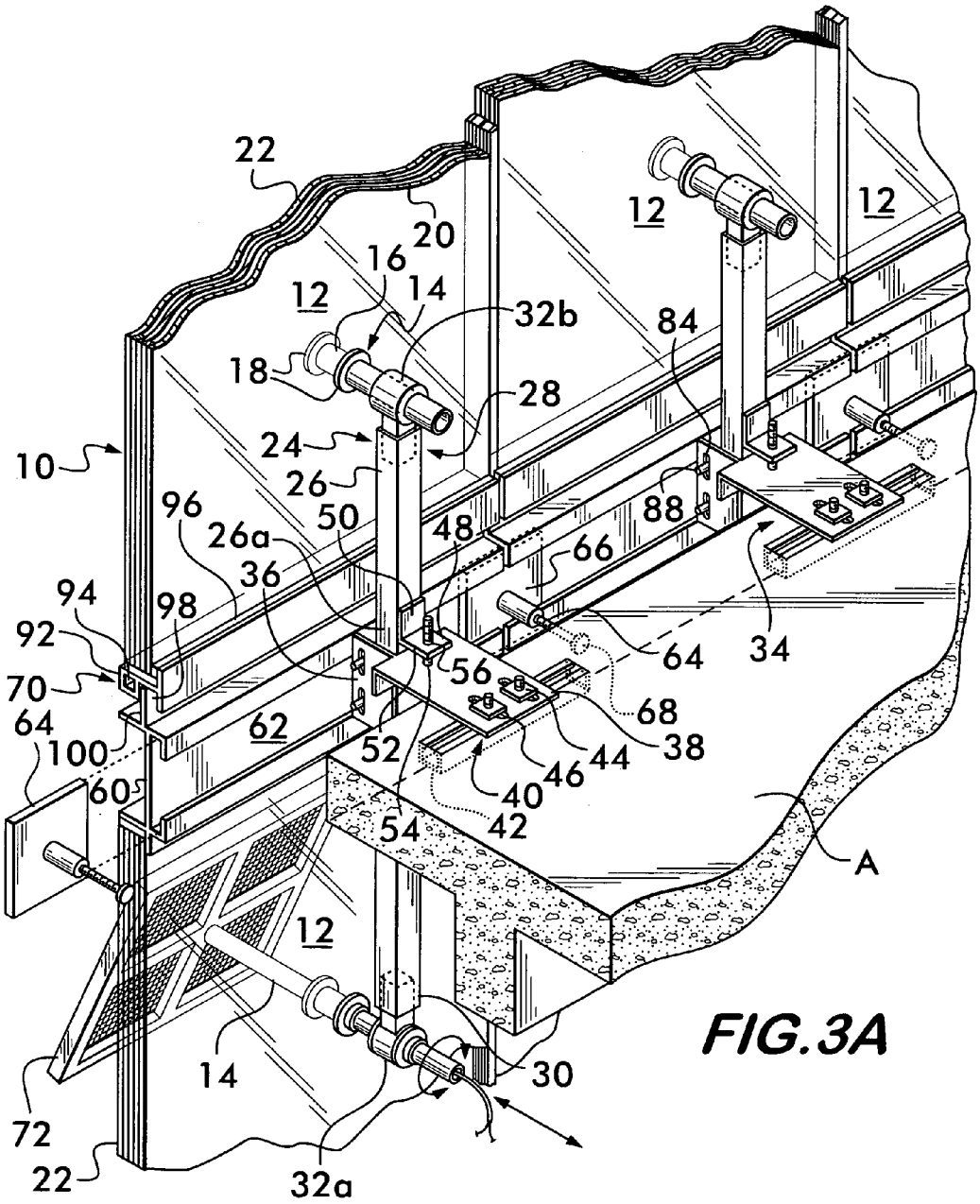
FIG. 3A is a side elevational view of the fitting, connection assembly and anchoring assembly used to secure adjacent panel assemblies to the façade of a building and to each other.

The connection assembly 24 of the upper and lower panel members 12 is secured to the façade A through an anchoring assembly 34 which is described herewith regard to reference FIG. 3A. The anchoring assembly 34 is comprised of a first bracket portion 36 extending longitudinally along a continguous portion 26*a* of the stanchion 26. A second bracket portion 38 runs perpendicular to the first bracket portion 36 and is secured to the façade A through an adjustable securing assembly 40.

The adjustable securing assembly 40 comprises a track 42 for receiving one or more track engaging devices 44 such as bolt assemblies which can be moved laterally within the track 42 to a variety of positions and secured therein to provide precise alignment of the anchoring assembly 34 with respect to stanchion 26.

The adjustable securing assembly 40 also provides adjustment perpendicular to the direction of the track 42 by one or more slots 46 in the second bracket portion 38 in which movement of the track engaging devices 44 within the slots 46 provides adjustment of the position of the stanchion toward or away from the façade A.

Attachment of the stanchion 26 to the second bracket portion 38 is made through any suitable connecting device such as an L-shaped connector 48 as shown in FIG. 3 having an opening for receiving a screw which is likewise engaged to the L-shaped connector 48.

The first bracket portion 36 as best shown in FIG. 3B secures the stanchion in place and provides means for vertical adjustment in accordance with the following.

The first bracket portion 36 includes a U-shaped bracket member 82 adapted to fit around a portion of the stanchion 26. The bracket member has a pair of slots 84 in opposed legs 86 (only one pair of legs and one pair of slots are shown). A pair of rods 88 is provided which are of sufficient size to be insertable into each of the pair of slots 84.

When making use of the U-shaped bracket to secure the stanchion to anchoring assembly 34, the stanchion 26 is provided with a pair of spaced apart sleeves 90 adapted to receive the rods 88 in advance of the rods 88 entering the second pair of slots 84. When the rods 88 are inserted into the respective pairs of slots 84 and sleeves 90, the stanchion 26 is secured in place within the anchoring assembly 34.

Vertical adjustments to the stanchion can be made through the second bracket portion 38 of the anchoring assembly 34. Referring to FIG. 3A, there is shown an L-shaped connector 48, having a first leg 50 which abuts the stanchion 26 and a second leg 52 running parallel the second bracket portion 38. A threaded screw 54 is insertable through an opening 56 in the second leg 52. By turning the screw clockwise or counterclockwise, the screw 54 will move the L-shaped connector 48 up or down which thereby moves the stanchion 26 up or down as well, thus providing vertical adjustment for the stanchion 26 so it can be properly aligned with the respective fittings 14.

Adjacent panels are secured to each other through a dual panel track system 60 in which panels are operatively secured to each other without the use of a perimeter frame. The dual panel track system also provides the ability to adjust the position of the panels to accommodate, for example, curvilinear façades as shown in FIG. 1. Referring to FIG. 3A, there is shown the track system 60 comprised of a track 62 positioned at the ends of the panel members 12. As shown in FIG. 3A, the track system 60 is positioned at the bottom end of an upper panel member 12 and the upper end of a lower panel member 12.

The track 62 is adapted to receive a track engaging device 64 comprised of a plate 66 insertable into the track 62 and slidable therein and a device 68 which can secure the plate 66 in the track 62 in a fixed position between adjacent panel members. The device 68 is adjustable and bears against the façade A and can be used to adjust the panel position so that the panels can accommodate a curvilinear design shown in FIG. 1 or a rectilinear design shown in FIG. 2.

The dual panel track system 60, and particularly the track 62, is secured in place between upper and lower panel members through a closure device 70 which is engaged to the panel member positioned above the track 62 to provide operable engagement of the dual panel track system to the panel members without the need for a perimeter frame.

The closure device 70 shown specifically in FIG. 3A includes a horizontally disposed platform 92 having a landing 94 for receiving the lower edge of the panel member 12. The inside surface 20 of the panel member is sealed to the platform 92 through a sealant 96. The platform 92 is provided with a cavity 98 for receiving an upwardly extending projection piece 100 extending from the dual panel track system 60.

In an optional feature of the present invention, the fitting 14, if made at least partially hollow can provide access to the exterior surface 22 of the panel member 12 to enable such materials as electrical assemblies 75 to be passed therethrough and thereby provide the means of providing electrical energy to various additions to the panel members.

In addition, the hollow fitting can assist ventilation by providing a pathway for the flow of air into or out of the building. Still further, the hollow fitting can provide a pathway for the placement of various equipment such as hydraulic lines, etc.

As shown best in FIGS. 1, 2 and 4, an addition to the panel member 12 in the form of, for example, a solar panel 72 may be operatively attached to the fitting 14 proximate to the exterior surface 22 of the panel member 12. The solar panel 72 may be provided with a conventional adjustable connection means (not shown) enabling the solar panel to be moved about the adjustable connector to align the solar panel 72 with the direction of the sun. An electrical connection between the solar panel and the façade A may be provided by passing electrical cables through the hollow filling 14 as shown best in FIG. 4.

In preferred aspects of the present invention, two fittings 14 engage each panel member in an area proximate to the longitudinal axis of the panel member as defined herein. Thus, the fittings may independently be aligned in an area within 10% of the width of the panel member from the longitudinal axis, more preferably within 5% of the width, most preferably within 1% of the width.

In addition, it is preferred to attach the upper fitting 14 of a panel member 12, a distance equivalent to between one-seventh to one-third of the length of the panel members 12 from its upper and lower edges, respectively, more preferably from one-sixth to one-quarter of the length of the panel members 12 from its upper and lower edges. The most preferred placement is one-fifth from the upper and lower edges.

The preferred panel members comprise three panels of glass separated from each other by an air space. As shown best in FIGS. 4 and 5, the panel member 12 is comprised of spaced apart panels 74 having an enclosed airspace 76 to facilitate thermal insulation.

A vertical seal 78 is positioned along the longitudinal abutment of adjacent panel members 12. As shown in FIG. 5, the vertical seal 78 is comprised of gasket 80 and a sealant 82 such as a silicone rubber sealant which seals the junction of the adjacent panels against infusion of rain, snow, wind, etc.

It will be noted that a number of features of the invention provide a panel assembly which withstands the bending forces due to wind thereby eliminating the need for a perimeter frame. The elimination of the perimeter frame also permits maximum transparency and the amount of light that may be transmitted through the panel members. The dual panel track system and the vertical seal prevent infusion of wind and rain while permitting relative panel member movement due to thermal gradients, internal floor loadings, building sway caused by wind and seismic forces. The dual panel track system stabilizes the panel members from rotation about the vertical axis thereof by transmitting uneven wind forces to the façade A.

The position of the fittings 14 as described herein and particularly the use of hollow fittings provided added benefits to the panel assembly enabling unique access between the interior to the exterior of the building.

The invention claimed is:

1. A panel assembly for mounting to the facade of a building comprising:

a) at least two vertically aligned panel members, each panel member of the two vertically aligned panel members having a substantially centered longitudinal axis, the substantially centered longitudinal axis of the two vertically aligned panel members being substantially aligned;

b) at least one opening in each of the vertically aligned panel members, said openings positioned in an area proximate to the longitudinal axis of each respective panel member;

c) a fitting having a first end portion extending into the opening of the vertically aligned panel members and an opposed second end portion;

d) a connection assembly comprising a stanchion operatively engaged to at least one of the fittings of each of a pair of vertically aligned panel members at said respective opposed second end portions thereof; and e) an anchoring assembly for receiving the connection assembly and securing the same to the facade of the building.

2. The panel assembly of claim 1 wherein the vertically aligned panel members are made of glass.

3. The panel assembly of claim 1 wherein the vertically aligned panel members are comprised of a plurality of panes with adjacent panes separated by an enclosed airspace.

4. The panel assembly of claim 1 comprising a plurality of openings.

5. The panel assembly of claim 1 wherein at least two openings are positioned in an area proximate to the longitudinal axis of the vertically aligned panel members.

6. The panel assembly of claim 4 wherein one of the openings is positioned a distance from the top of each of the vertically aligned panel members corresponding to between one-seventh and one-third of the length of each of the vertically aligned panel members.

7. The panel assembly of claim 6 wherein one of the openings is positioned a distance from the bottom of each of the vertically aligned panel members corresponding to between one-seventh and one-third of the length of each of the vertically aligned panel members.

8. The panel assembly of claim 7 having two openings wherein one opening is positioned a distance from the top of one of the vertically aligned panel members corresponding to one-sixth to one-quarter of the length said one of the vertically aligned panel member and the second opening is positioned a distance from the bottom of said one of the vertically aligned panel member corresponding to one-sixth to one-quarter of the length of said one of the vertically aligned panel member.

9. The panel assembly of claim 1 wherein the opening is cylindrical.

10. The panel assembly of claim 1 wherein the connection assembly comprises a stanchion extending substantially parallel to the longitudinal axis having a first end and connection means for connecting the first end of the stanchion to the fitting.

11. The panel assembly of claim 10 wherein the connection means comprises a first portion operatively engaged to the stanchion and a second portion circumscribing a portion of the fitting.

12. The panel assembly of claim 10 wherein the anchoring assembly further comprises anchoring means for anchoring the stanchion to the façade of the building.

13. The panel assembly of claim 12 wherein the anchoring means comprises a stanchion receiving portion for securing the stanchion to the anchoring assembly and a façade securing portion for securing the anchoring assembly to the façade.

14. The panel assembly of claim 10 wherein the stanchion has a second end remote from the first end, said second end adapted to engage a second fitting operatively engaged to another of said vertically aligned panel members.

15. The panel assembly of claim 1 further comprising a frame operatively engaged to the first end of the fitting.

16. The panel assembly of claim 1 wherein the fitting is at least partially hollow and thereby provides a pathway through the vertically aligned panel members.

17. The panel assembly of claim 15 wherein the frame is spaced apart from the vertically aligned panel members.

18. The panel assembly of claim 17 wherein the frame comprises a solar device.

19. The panel assembly of claim 15 further comprising electrical power means extending through the fitting to the frame.

* * * * *